US010559870B2

(12) United States Patent
Wu et al.

(10) Patent No.: US 10,559,870 B2
(45) Date of Patent: Feb. 11, 2020

(54) ANTENNA MODULE

(71) Applicant: PEGATRON CORPORATION, Taipei (TW)

(72) Inventors: Chien-Yi Wu, Taipei (TW); Ya-Jyun Li, Taipei (TW); Chao-Hsu Wu, Taipei (TW); Shih-Keng Huang, Taipei (TW); Cheng-Hsiung Wu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 336 days.

(21) Appl. No.: 15/401,110

(22) Filed: Jan. 9, 2017

(65) Prior Publication Data

US 2017/0229759 A1 Aug. 10, 2017

(30) Foreign Application Priority Data

Feb. 5, 2016 (TW) ..... 105104106 A

(51) Int. Cl.

| | |
|---|---|
| ***H01Q 1/22*** | (2006.01) |
| ***H01Q 1/48*** | (2006.01) |
| ***H01Q 21/28*** | (2006.01) |
| ***H01Q 13/16*** | (2006.01) |
| *H01Q 13/10* | (2006.01) |

(52) U.S. Cl.

CPC ..... *H01Q 1/2266* (2013.01); *H01Q 1/48* (2013.01); *H01Q 13/16* (2013.01); *H01Q 21/28* (2013.01); *H01Q 13/10* (2013.01)

(58) Field of Classification Search

CPC ..... H01Q 1/2266; H01Q 1/48; H01Q 13/16; H01Q 21/28; H01Q 13/10

See application file for complete search history.

(56) References Cited

U.S. PATENT DOCUMENTS

| | | | | |
|---|---|---|---|---|
| 8,547,283 | B2 | 10/2013 | Wong et al. | |
| 2010/0238079 | A1 | 9/2010 | Ayatollahi et al. | |
| 2012/0001815 | A1* | 1/2012 | Wong | H01Q 1/243 343/749 |
| 2015/0200448 | A1 | 7/2015 | Tsai et al. | |

(Continued)

FOREIGN PATENT DOCUMENTS

| | | | |
|---|---|---|---|
| CN | 103682583 | A | 3/2014 |
| EP | 3200281 | A1 | 8/2017 |
| JP | 5824563 | B1 | 10/2015 |

(Continued)

*Primary Examiner* — Hai V Tran
*Assistant Examiner* — Michael M Bouizza
(74) *Attorney, Agent, or Firm* — McClure, Qualey & Rodack, LLP

(57) ABSTRACT

An antenna module connected to a system ground of an electronic device includes a substrate, a coaxial-transmission line, a first radiator and a second radiator. The coaxial-transmission line includes a power feed-in terminal and a ground terminal. The first radiator is electrically connected to the power feed-in terminal. The second radiator is electrically connected to the ground terminal. One side of the second radiator is connected to the system ground, and the second radiator includes a first terminal and a second terminal. An opening is formed between the first terminal and the second terminal, so that the second radiator be partially surrounding to the first radiator. The first radiator and the second radiator are coplanarly disposed on the substrate.

14 Claims, 6 Drawing Sheets

(56) References Cited

U.S. PATENT DOCUMENTS

2019/0006766 A1 1/2019 Yonei et al.

FOREIGN PATENT DOCUMENTS

| | | | |
|---|---|---|---|
| TW | I255588 | B | 5/2006 |
| TW | 200905987 | A | 2/2009 |
| TW | I352456 | B | 11/2011 |
| TW | I487198 | B | 6/2015 |
| WO | 2009146282 | A1 | 12/2009 |
| WO | 2014000667 | A1 | 1/2014 |

* cited by examiner

ANTENNA MODULE

RELATED APPLICATIONS

This application claims priority to Taiwan Application Serial Number 105104106, filed Feb. 5, 2016, which is herein incorporated by reference.

BACKGROUND

Field of Invention

The present disclosure relates to an element module. More particularly, the present disclosure relates to an antenna module.

Description of Related Art

With the rapid development of network technology, a communication electronic device being able to connect to the Internet is playing an increasingly important role in human life. Simultaneously, requirements of external appearance and portability of a communication electronic device from persons become gradually stringent due to generalization of the communication electronic device. Generally speaking, many manufactures decrease entire volume of a communication electronic device by improving an antenna module. However, in order to improve an antenna module, not only adjustment and control of operational frequencies of the antenna module should be considered, but manpower consumption of manufacturing the antenna module should also be considered.

Accordingly, a significant challenge is related to ways in which to remain operation of an antenna module while at the same time and decreasing cost of manufacturing the antenna module associated with designing and downsizing antenna modules.

SUMMARY

An aspect of the present disclosure is directed to an antenna module. The antenna module connected to a system ground of an electronic device includes a substrate, a coaxial-transmission line, a first radiator and a second radiator. The coaxial-transmission line includes a power feed-in terminal and a ground terminal. The first radiator is electrically connected to the power feed-in terminal. The second radiator is electrically connected to the ground terminal. One side of the second radiator is connected to the system ground, and the second radiator includes a first terminal and a second terminal. An opening is formed between the first terminal and the second terminal, so that the second radiator be partially surrounding to the first radiator. The first radiator and the second radiator are coplanarly disposed on the substrate.

Another aspect of the present disclosure is directed to an antenna module. The antenna module connected to a system ground of an electronic device includes a substrate, a first coaxial-transmission line, a second coaxial-transmission line, a first radiator, a second radiator and a third radiator. The first coaxial-transmission line includes a first power feed-in terminal and a first ground terminal. The second coaxial-transmission line includes a second power feed-in terminal and a second ground terminal. The first radiator is electrically connected to the first power feed-in terminal. The second radiator is electrically connected to the second power feed-in terminal. The third radiator is electrically connected to the first ground terminal and the second ground terminal. One side of the third radiator is connected to the system ground, and the second radiator includes a first terminal, a second terminal, a third terminal and a fourth terminal, so that the third radiator is partially surrounding to the first radiator and the second radiator. A first opening is formed between the first terminal and the second terminal, and a second opening is formed between the third terminal and the fourth terminal. The first radiator, the second radiator and the third radiator are coplanarly disposed on the substrate.

It is to be understood that the foregoing general description and the following detailed description are by examples, and are intended to provide further explanation of the invention as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
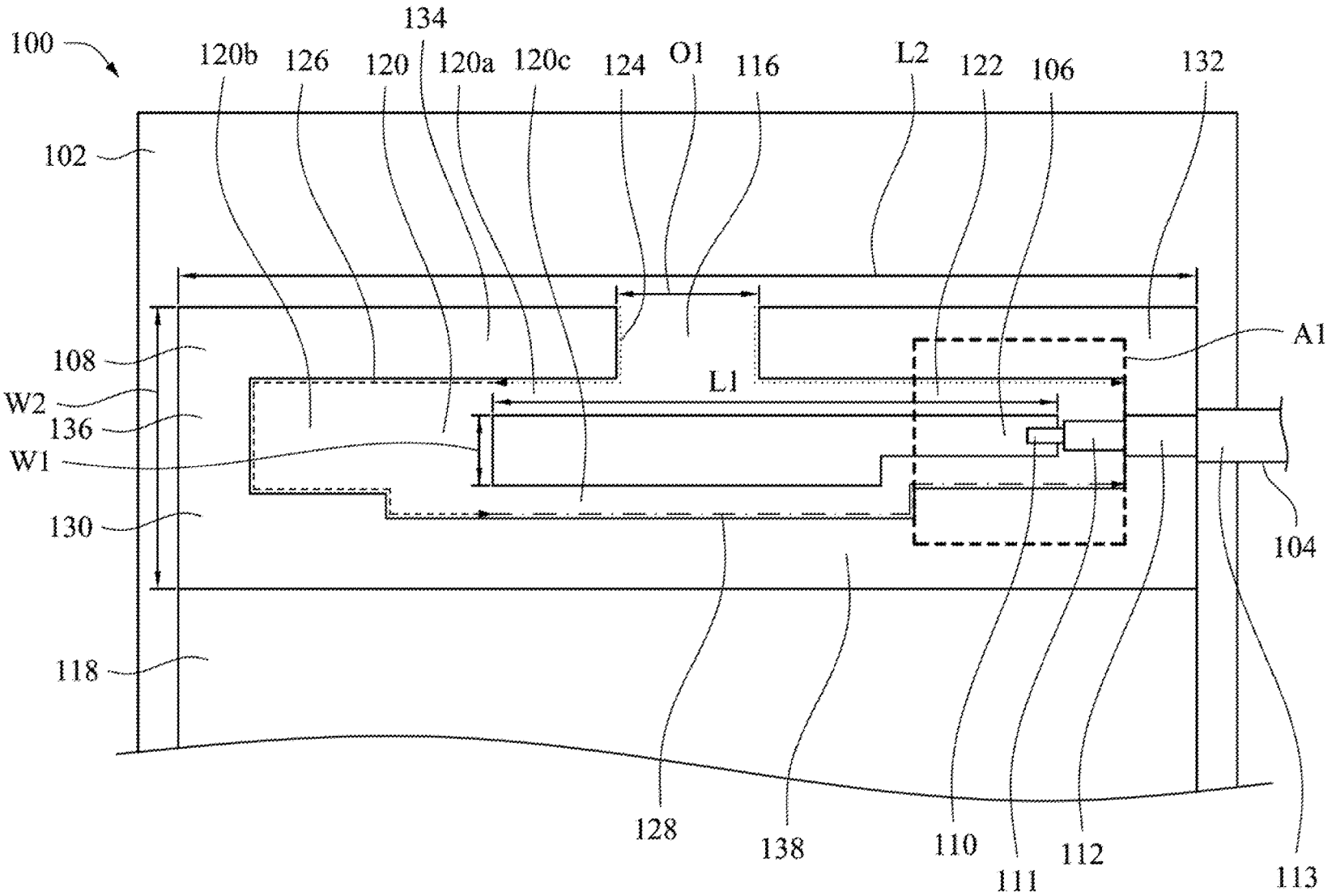
FIG. 1 is a schematic diagram of an antenna module according to embodiments of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

FIG. 1 is a schematic diagram of an antenna module according to one embodiment of the present disclosure. As shown in FIG. 1, an antenna module 100 includes a substrate 102, a coaxial-transmission line 104, a first radiator 106 and a second radiator 108. The coaxial-transmission line 104 includes a power feed-in terminal 110 and a ground terminal 112. The first radiator 106 is electrically connected to the power feed-in terminal 110, and the second radiator 108 is electrically connected to the ground terminal 112. For example, the first radiator 106 and the second radiator 108 are made of metal or any material which can be used to be conductive.

For example, the coaxial-transmission line 104 includes the power feed-in terminal 110, a first non-conductive section 111, the ground terminal 112 and a second non-conductive section 113. Firstly, the power feed-in terminal 110 is disposed as a center, and then the power feed-in terminal 110, the first non-conductive section, the ground terminal 112 and the second non-conductive section are sequentially encased to form the coaxial-transmission line 104.

In this embodiment, the second radiator 108 is partially surrounding to the first radiator 106, and the first radiator 106 and the second radiator 108 are coplanarly disposed on the substrate 102. For example, the first radiator 106 is indirectly connected to the second radiator 108. In one embodiment, the first radiator 106 and the second radiator 108 are directly disposed on the substrate 102. For example, there is no element disposed between the first radiator 106 and the substrate 102, and there is no element disposed between the second radiator 108 and the substrate 102.

One side of the second radiator 108 is connected to a system ground 118, and the system ground 118 is configured to connect the antenna module 100 with other elements. For example, the system ground 118 can be made of cooper foil or any material which can be used to stably connect the antenna module 100 with other function elements. The function elements connected to the antenna module 100 via the system ground 118 can be a charging element, a photographic element, a touch element or a displaying element, etc. The second radiator 108 includes a first terminal and a second terminal, and an opening 116 is formed between the first terminal and the second terminal of the second radiator 108, so that the second radiator 108 is partially surrounding to the first radiator 106. It should be that, the embodiments mentioned above are merely used for illustrating manners of implementing the opening 116, and the present invention is not limited thereto.

Several slots are formed between the first radiator 106 and the second radiator 108 (such as, a first slot 120 and a second slot 122 as shown in FIG. 1), and these slots are respectively in connection with the opening 116. For example, when the first radiator 106 is disposed on the substrate 102 and indirectly connected to the second radiator 108, a distance is located between the first radiator 106 and the second radiator 108. In this embodiment, the distance located between the first radiator 106 and the second radiator 108 is used to form several slots, and these slots are in connection with the opening 116.

In one embodiment, a slot is formed by a first slit (such as, a first slit 120*a* as shown in FIG. 1), a connection slit (such as, a connection slit 120*b* as shown in FIG. 1) and a second slit (such as, a second slit 120*c* as shown in FIG. 1). For example, one terminal of the first slit is in connection with the opening 116, and the other terminal of the first slit and one terminal of the second slit are respectively in connection with the connection slit. The slot can be formed by a permutation of the first slit, the connection slit and the second slit. For example, the slot can be formed merely by the connection slit or by the first slit and the second slit, and the sequence among the first slit, the connection slit and the second slit to form the first slot can be adjusted. It should be noted that, the manners of implementing the slot are used for illustration, and the present invention is not limited thereto.

According to the embodiments mentioned above, an operational band of the antenna module 100 relates to an extending distance of the first slit, an extending distance of the connection slit and an extending distance of the second slit. Specifically, the extending distance are respectively measured from one terminal of the first slit, the connection slit and the second slit to the other terminal of the first slit, the connection slit and the second slit along an internal side of the second radiator 108. In other words, the extending distance of the first slit can be obtained according to an extending length from one terminal which the first slit is in connection with the opening 116 to the other terminal which the first slit is in connection with the connection slit along the internal side of the second radiator 108 (such as, an extending distance 124 as shown in FIG. 1); the extending distance of the connection slit can be obtained according to an extending length from one terminal which the connection slit is in connection with the first slit to the other terminal which the connection slit is in connection with the second slit along the internal side of the second radiator 108 (such as, an extending distance 126 as shown in FIG. 1); the extending distance of the second slit can be obtained according to an extending length from one terminal which the second slit is in connection with the connection slit to the other terminal of the second slit along the internal side of the second radiator 108 (such as, an extending distance 128 as shown in FIG. 1). In one embodiment, with respect to the extending distance of the first slit and the extending distance of the second slit which merely relate to length implementation of the first slit and the second slit, the extending distance of the connection slit relates to length implementation and width implementation of the connection slit. For example, the first slit and the second slit can be straight slits (such as, the first slit 120*a* and the second slit 120*c* as shown in FIG. 1), and the connection slit can be a zigzag slit (such as, the connection slit 120*b* as shown in FIG. 1). The specific extending distance of the connection slit can be further extended by the width implementation.

In one embodiment, the second radiator 108 includes a first radiating section 130 and a second radiating section 132. For example, the first radiating section 130 includes the first terminal of the second radiator 108. Additionally, the first slot 120 is formed between the first radiator 106 and the first radiating section 130, and the second slot 122 is formed between the first radiator 106 and the second radiating section 132. The first slot 120 and the second slot 122 are in connection with the opening 116, and the first slot 120 non-overlaps the second slot 122.

In further embodiment, the first radiating section 130 includes a first radiating sub-section 134, a second radiating sub-section 136 and a third radiating sub-section 138. The first slit 120*a* is formed between the first radiator 106 and the first radiating sub-section 134; the connection slit 120*b* is formed between the first radiator 106 and the second radiating sub-section 136; the second slit 120*c* is formed between the first radiator 106 and the third radiating sub-section 138. An operational band of the antenna module 100 relates to the extending distance 124 of the first slit 120*a*, the extending distance 126 of the connection slit 120*b* and the extending distance 128 of the second slit 120*c*. Manners of measuring the extending distance 124 of the first slit 120*a*, the extending distance 126 of the connection slit 120*b* and the extending distance 128 of the second slit 120*c* are illustrated by the previous embodiments, so these will not be repeated. Additionally, in this embodiment, although the second slot 122 does not include a connection slit, the connection slit still can be implemented in the second slot 122. For example, the connection slit can be disposed in an area A1, so that the specific extending distance of the second slit can be further extended. Since formation of the second slot 122 is similar to that of the first slot 120, so this will not be repeated.

According to the embodiments mentioned above, energy is provided to the antenna module 100 via the power feed-in terminal 110 of the coaxial-transmission line 104. Then, the ground terminal 112 is connected to the second radiator 108 to conduct electricity to the system ground 118, so that the antenna module 100 respectively generates a first operational band and a second operational band via the first slot 120 and the second slot 122. In other words, when the antenna module 100 is designed, resonant frequencies and impedance bandwidths of the first operational band and the second operational band generated from the antenna module 100 can be adjusted by adjusting the extending distance corresponding to the first slot and the second slot. For example, the first operational band can represent a wireless band 2.4 GHz supported by Wi-Fi, and the operational band can represent a wireless band 5 GHz supported by Wi-Fi.

In one embodiment, when the first operational band represents the wireless band 2.4 GHz supported by Wi-Fi, and the second operational band represents the wireless band 5 GHz supported by Wi-Fi, a length L1 of the first radiator 106 is in the range of 10 millimeters to 15 millimeters, and a width W1 of the first radiator 106 is in the range of 0.5 millimeter to 1.5 millimeters; a length L2 of the second radiator 108 is 30 millimeters, and a width W2 of the second radiator 108 is 5 millimeters; an opening width O1 of the opening 116 is 1.5 millimeters. It should be noted that, the specific implementation of the first radiator 106, the second radiator 108 and the opening 116 in this embodiment, are used for illustration, and the present invention is not limited thereto.

In the embodiments as shown in FIG. 1, the antenna module 100 which applies the single coaxial-transmission line 104 is a single feed-in and double-band antenna module. Since the antenna module 100 applies the single coaxial-transmission line 104, the antenna module 100 can simultaneously operate at the first operational band and the second operational band. It should be noted that, the single feed-in and double-band antenna module which applies the single coaxial-transmission line 104 in this embodiment is merely used for illustrating some possible manners of implementing the antenna module 100, and the present invention is not limited thereto. For example, the antenna module can be designed as a single feed-in antenna module or a multi-feed-in antenna module or be designed as a double-band antenna module or a multi-band antenna module by adjusting the number of the coaxial-transmission lines or an extending distance of a slot while designing the antenna module.

Figure 2:
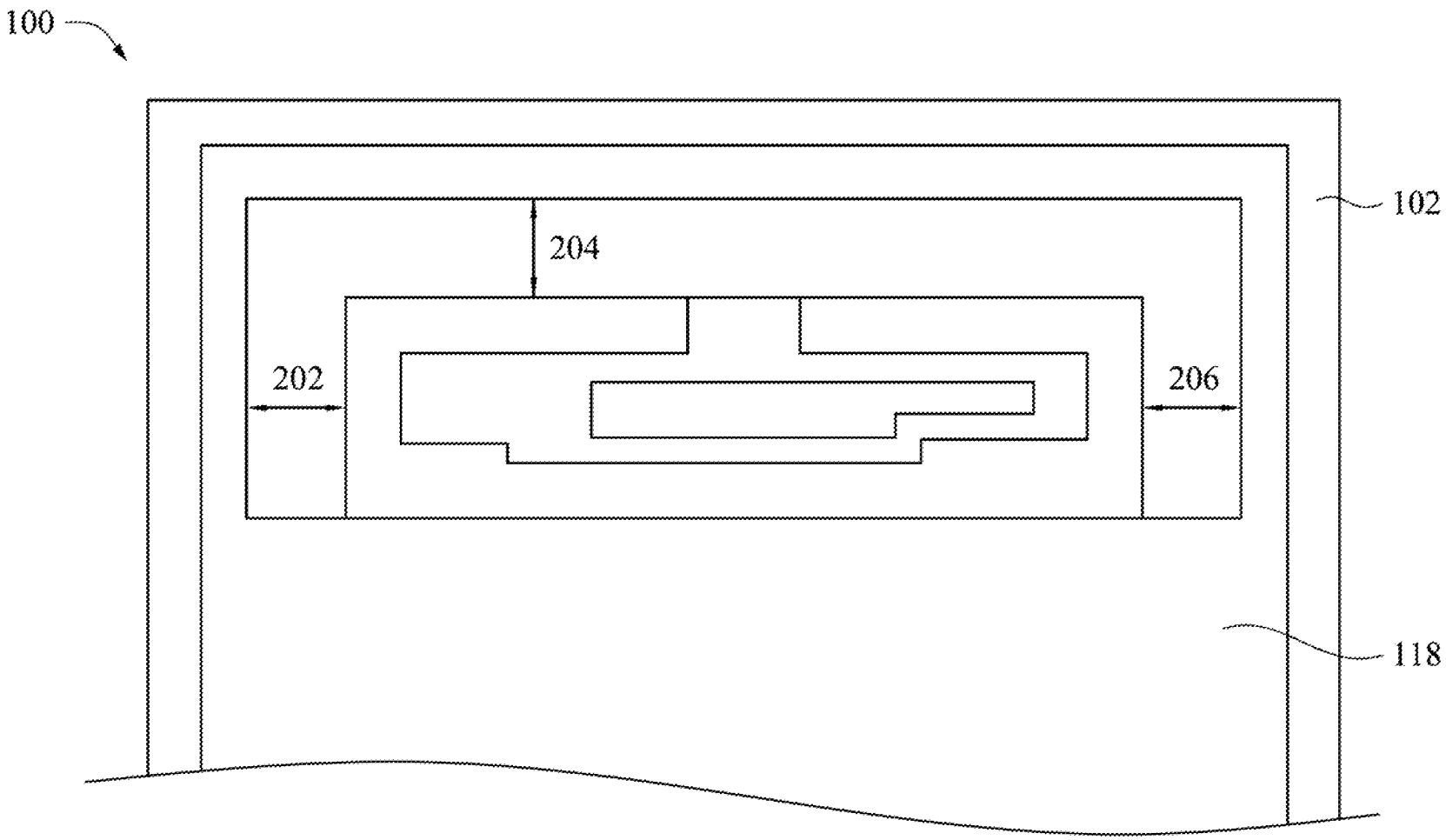
FIG. 2 is a schematic diagram of configuration of an antenna module according to embodiments of the present disclosure.

FIG. 2 is a schematic diagram of configuration of an antenna module according to one embodiment of the present disclosure. In one embodiment, configuration of this antenna module can be applied to that of the antenna module 100 mentioned above, but the present invention is not limited thereto. As shown in FIG. 2, in addition to a joint edge located between the antenna module 100 and system ground 118, a distance 202, a distance 204 and a distance 206 are respectively located between the antenna module 100 and the system ground 118. The distance 202, the distance 204 and the distance 206 relate to a relative distance between the antenna module 100 and other metal elements. The distance between the other metal elements and the antenna module 100 affect operation of the antenna module 100 directly and correlatively. For example, when another antenna module is disposed around the antenna module 100, a voltage standing wave ratio (VSWR) generated from the operation of the antenna module 100 and isolation among different antenna modules are affected according to relative distance between the other antenna module and the antenna module 100 correspondingly.

In one embodiment, when the distance 202 and the distance 206 are 10 millimeters, and the distance 204 is 5 millimeters, an effect caused by other metal elements being surrounding to the antenna module 100 can be reduced. It should be notate that, the specific implementation of the distance 202, the distance 204 and the distance 206 in this embodiment are used for illustration, and the present invention is not limited thereto.

Figure 3A:
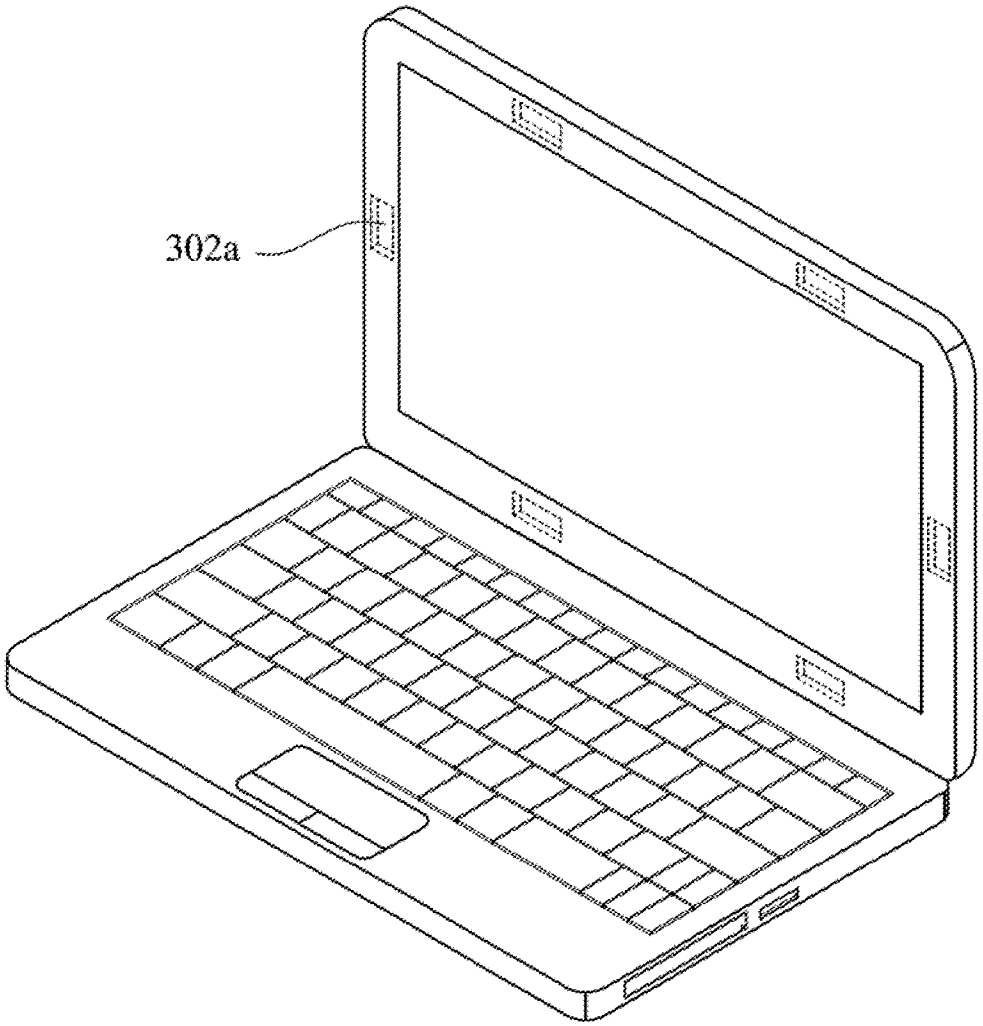
FIG. 3A and FIG. 3B are schematic diagrams of configuration of an antenna module according to embodiments of the present disclosure.
Figure 3B:
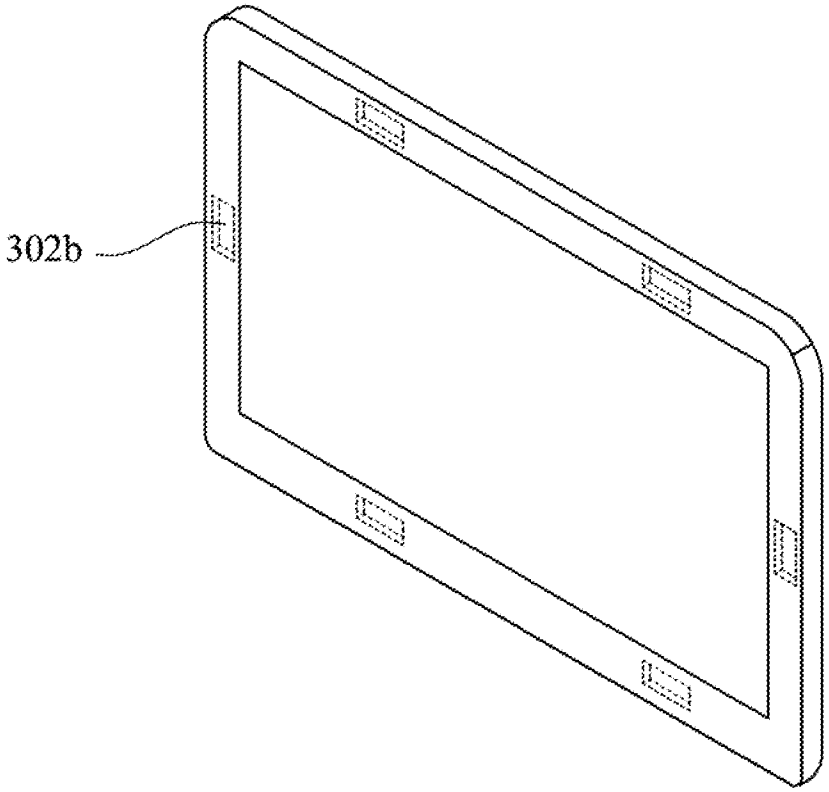

FIG. 3A and FIG. 3B are schematic diagrams of configuration of an antenna module according to embodiments of the present disclosure. In one embodiment, the configuration of this antenna module can be applied to that of the antenna module 100 mentioned above, but the present invention is not limited thereto. As shown in FIG. 3A and FIG. 3B, the antenna module can be applied to a laptop computer or a tablet computer, and a specific implementation manner is to dispose the antenna module in antenna configuration areas 302*a*/302*b*.

In one embodiment, a relative distance between the possible antenna configuration area 302*a* and the possible antenna configuration area 302*b* relates to a voltage standing wave ration generated from operations of antenna modules and isolation among the antenna modules (as shown in FIG. 2). In other words, the possible antenna configuration areas 302*a*/302*b* relate to an antenna gain and an envelope correlation coefficient (ECC) achieved by disposing and operating the antenna modules in the antenna configuration areas 302*a*/302*b*. It should be noted that, this embodiment is merely used for illustrating some manners of implementing the possible antenna configuration areas 302*a*/302*b*, and the present invention is not limited thereto.

Figure 4:
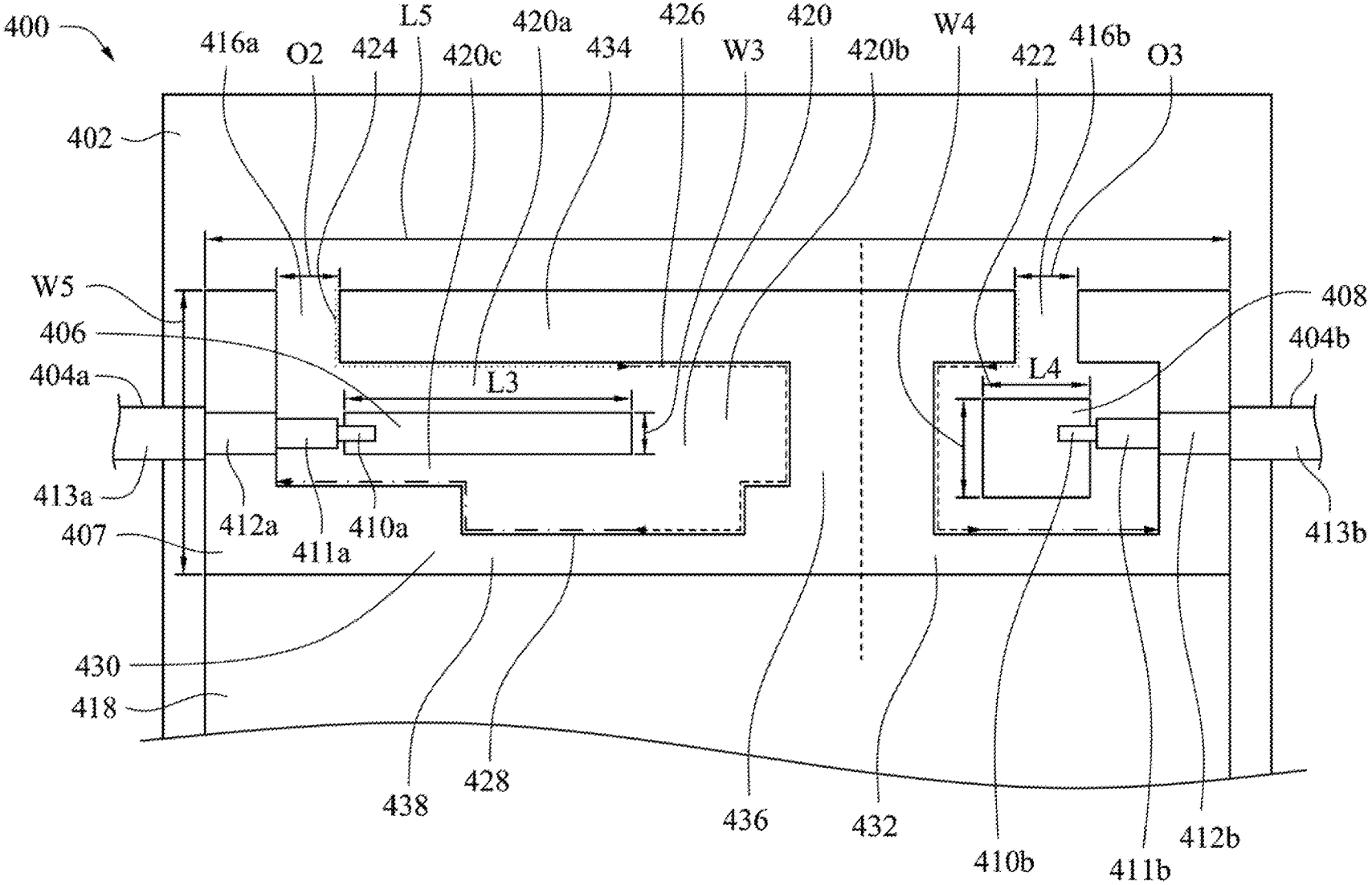
FIG. 4 is a schematic diagram of an antenna module according to embodiments of the present disclosure.

FIG. 4 is a schematic diagram of an antenna module according to one embodiment of the present disclosure. As shown in FIG. 4, an antenna module 400 includes a substrate 402, a first coaxial-transmission line 404*a*, a second coaxial-transmission line 404*b*, a first radiator 406, a second radiator 408 and a third radiator 407. The first coaxial-transmission line 404*a* includes a first power feed-in terminal 410*a* and a first ground terminal 412*a*, and the second coaxial-transmission line 404*b* includes a second power feed-in terminal 410*b* and a second ground terminal 412*b*. The first radiator 406 is electrically connected to the first power feed-in terminal 410*a*. The second radiator 408 is electrically connected to the second power feed-in terminal 410*b*. The third radiator 407 is electrically connected to the first ground terminal 412*a* and the second ground terminal 412*b*. For example, the first radiator 406, the second radiator 408 and the third radiator 407 are made of metal or any material which can be used to be conductive.

For example, the first coaxial-transmission line 404*a* includes the first power feed-in terminal 410*a*, a first non-conductive section 411*a*, the first ground terminal 412*a* and a second non-conductive section 413*a*. Firstly, the first power feed-in terminal 410*a* is disposed as a center, and then the first power feed-in terminal 410*a*, the first non-conductive section 411*a*, the first ground terminal 412*a* and the second non-conductive section 413*a* are sequentially encased to form the first coaxial-transmission line 404*a*. The second coaxial-transmission line 404*b* includes the second power feed-in terminal 410*b*, a first non-conductive section 411*b*, the second ground terminal 412*b* and a second non-conductive section 413*b*. Since formation of the second coaxial-transmission line 404*b* is to the same as that of the first coaxial-transmission line 404*a*, so this will not be repeated.

In this embodiment, the third radiator 407 is partially surrounding to the first radiator 406 and the second radiator 408, and the first radiator 406, the second radiator 408 and the third radiator 407 are coplanarly disposed on the substrate 402. In one embodiment, the first radiator 406, the second radiator 408 and the third radiator 407 are directly disposed on the substrate 402. For example, there is no element disposed between the first radiator 406 and the substrate 402; there is no element disposed between the second radiator 408 and the substrate 4021; there is no element disposed between the third radiator 407 and the substrate 402.

One side of the third radiator 407 is connected to the system ground 418, and the system ground 418 is configured to connect the antenna module 400 with other elements. For example, the system ground 418 can be made of cooper foil or any material which can be used to stably connect the antenna module 400 with other function elements. The function elements connected to the antenna module 400 via the system ground 418 can be a charging element, a photographic element, a touch element or a displaying element, etc. The third radiator 407 includes a first terminal, a second terminal, a third terminal and a fourth terminal. A first opening 416*a* is formed between the first terminal and the second terminal of the third radiator 407, and a second opening 416*b* is formed between the third terminal and the fourth terminal of the third radiator 407, so that the third radiator 407 is partially surrounding to the first radiator 406 and the second radiator 408. It should be noted that, the embodiments mentioned above are merely used for illustrating some manners of implementing the first opening 416*a* and the second opening 416*b*, and the present invention is not limited thereto.

Several slots which are in connection with the first opening 416*a* are formed between the first radiator 406 and the third radiator 407 (such as, a first slot 420 as shown in FIG. 4), and several slots which are in connection with the second opening 416*b* are formed between the second radiator 408 and the third radiator 407 (such as, a second slot 422 as shown in FIG. 4). For example, since the first radiator 406 and the second radiator 408 are disposed on the substrate 402 and indirectly connected to the third radiator 407, a distance is located between the first radiator 406 and the third radiator 407, and a distance is located between the second radiator 408 and the third radiator 407. In this embodiment, the distance between the first radiator 406 and the third radiator 407 and the distance between the second radiator 408 and the third radiator 407 are used to form several slots, and these slots are respectively in connection with the first opening 416*a* and the second opening 416*b*.

In one embodiment, a slot is formed by a first slit (such as, a first slit 420*a* as shown in FIG. 4), a connection slit (such as, a connection slit 420*b* as shown in FIG. 4) and a second slit (such as, a second slit 420*c* as shown in FIG. 4). For example, one terminal of the first slit is in connection with one of the first opening 416*a* and the second opening 416*b*, and the other terminal of the first slit and one terminal of the second slit are respectively in connection with the connection slit. The slot can be formed by a permutation of the first slit, the connection slit and the second slit. For example, the slot can be formed merely by the connection slit or by the first slit and the second slit, and the sequence among the first slit, the connection slit and the second slit to form the first slot can be adjusted. It should be noted that, the manners of implementing the slot are used for illustration, and the present invention is not limited thereto.

According to the embodiments mentioned above, an operational band of the antenna module 400 relates to an extending distance of the first slit, an extending distance of the connection slit and an extending distance of the second slit. Specifically, the extending distance are respectively measured are from one terminal of the first slit, the connection slit and the second slit to the other terminal of the first slit, the connection slit and the second slit along an internal side of the third radiator 407. In other words, the extending distance of the first slit can be obtained according to an extending length from one terminal which the first slit is in connection with one of the first opening 416*a* and the second opening 416*b* to the other terminal which the first slit is in connection with the connection slit along the internal side of the third radiator 407 (such as, an extending distance 424 as shown in FIG. 4); the extending distance of the connection slit can be obtained according to an extending length from one terminal which the connection slit is in connection with the first slit to the other terminal which the connection slit is in connection with the second slit along the internal side of the third radiator 407 (such as, an extending distance 426 shown in FIG. 4); the extending distance of the second slit can be obtained according to an extending length from one terminal which the second slit is in connection with the connection slit to the other terminal of the second slit along the internal side of the third radiator 407 (such as, an extending distance 428 as shown in FIG. 4). In one embodiment, with respect to the extending distance of the first slit and the second slit which merely relate to length implementation of the first slit and the second slit, the extending distance of the connection slit relates to length implementation and width implementation of the connection slit. For example, the first slit and the second slit can be straight slits (such as, the first slit 420*a* and the second slit 420*c* as shown in FIG. 4), and the connection slit can be a zigzag slit (such as, the connection slit 420*b* as shown in FIG. 4). The specific extending distance of the connection slit can be further extended by the width implementation.

In one embodiment, the third radiator 407 includes a first radiating section 430 and a second radiating section 432 (such as, a dash line divides the third radiator 407 into the first radiating section 430 and the second radiating section 432 as shown in FIG. 4). The first radiating section 430 is partially surrounding to the first radiator 406, and the second radiating section 432 is partially surrounding to the second radiator 408. For example, the first radiating section 430 includes a first terminal and a second terminal of the third radiator 40, and the second radiating section 432 includes a third terminal and a fourth terminal of the third radiator 407.

Additionally, the first slot 420 is formed between the first radiator 406 and the first radiating section 430, and the second slot 422 is formed between the second radiator 408 and the second radiating section 432. The first slot 420 and the second slot 422 are respectively in connection with the first opening 416*a* and the second opening 416*b*, and the first slot 420 non-overlaps the second slot 422. Furthermore, a size of the first radiating section 430 and a size of the second radiating section 432 are asymmetric, so that the extending distance corresponding to the first slot 420, the extending distance corresponding to the second slot 422 and operational bands generated from the antenna module 400 are directly affected. Specifically, in the embodiment as shown in FIG. 4, the extending distance of the first slot 420 is different from that of the second slot 422, thus the operational bands generated from the antenna module 400 respectively via the first slot 420 and the second slot 422 are different.

In further embodiment, the first radiating section 430 includes a first radiating sub-section 434, a second radiating sub-section 436 and a third radiating sub-section 438. The first slit 420*a* is formed between the first radiator 406 and the first radiating sub-section 434; the connection slit 420*b* is formed between the first radiator 406 and the second radiating sub-section 436; the second slit 420*c* is formed between the first radiator 406 and the third radiating sub-section 438. An operational band of the antenna module 400 relates to the extending distance 424 of the first slit 420*a*, the extending distance 426 of the connection slit 420*b* and the extending distance 428 of the second slit 420*c*. Manners of measuring the extending distance 424 of the first slit 420*a*, the extending distance 426 of the connection slit 420*b* and the extending distance 428 of the second slit 420*c* are illustrated by the previous embodiments, so these will not be repeated. Additionally, since formation of the second slot 422 is similar to that of the first slot 420, so this will not be repeated.

According to the embodiments mentioned above, energy is provided to the antenna module 400 respectively via the first power feed-in terminal 410*a* of the first coaxial-transmission line 404*a* and the second power feed-in terminal 410*b* of the second coaxial-transmission line 404*b*. Then, the first ground terminal 412*a* and the second ground terminal 412*b* are respectively connected to the third radiator 407 to conduct electricity to the system ground 418, so that the antenna module 400 respectively generates a first operational band and a second operational band via the first slot 420 and the second slot 422. In other words, when the antenna module 400 is designed, resonant frequencies and impedance bandwidths of the first operational band and the second operational band generated from the antenna module 400 can be adjusted by adjusting the extending distance corresponding to the first slot and the second slot. For example, the first operational band can represent a wireless band 2.4 GHz supported by Wi-Fi, and the second operational band can represent a wireless band 5 GHz supported by Wi-Fi.

In one embodiment, when the first operational band represents the wireless band 2.4 GHz supported by Wi-Fi, and the second operational band represents the wireless band 5 GHz supported by Wi-Fi, a length L3 of the first radiator 406 is in the range of 7 millimeters to 8 millimeters, and a width W3 of the first radiator 406 is 0.5 millimeters; a length L4 of the second radiator 408 is in the range of 2 millimeters to 3 millimeters, and a width W4 of the second radiator 408 is 1.5 millimeters; a length L5 of the third radiator 407 is 30 millimeters, and a width W5 of the third radiator 407 is 5 millimeters; an opening width O2 of the first opening 416*a* is 1.5 millimeters, and an opening width O3 of the second opening 416*b* is 0.5 millimeters. It should be noted that, the specific implantation of the first radiator 406, the second radiator 408, the third radiator 407, the first opening 416*a* and the second opening 416*b* in this embodiment are merely used for illustration, and the present invention is not limited thereto.

In the embodiment as shown in FIG. 4, the antenna module 400 which applies the first coaxial-transmission line 404*a* and the second coaxial-transmission line 404*b* is a double feed-in and double-band antenna module. Since the antenna module 400 simultaneously applies the first coaxial-transmission line 404*a* and the second coaxial-transmission line 404*b*, the antenna module 400 can not only simultaneously operate at the first operational band and the second operational band, but also operate at one of the first operational band and the second operational band by non-simultaneously providing energy for the antenna module 400. It should be noted that, the double feed-in and double-band antenna module which applies the double coaxial-transmission lines in the embodiments mentioned above is used for illustrating some possible manners of implementing the antenna module 400, and the present invention is not limited thereto. For example, the antenna module can be designed as a double feed-in antenna module or a multi-feed-in antenna module or be designed as a double-band antenna module or a multi-band antenna module by adjusting the number of the coaxial-transmission lines or an extending distance of a slot while designing the antenna module.

In one embodiment, possible configuration manners and application manners of the antenna module 400 are illustrated by the embodiments as shown in FIG. 2, FIG. 3A and FIG. 3B, so these will not be repeated. It should be noted that, the embodiments mentioned above are merely used for illustrating specific configuration manners and application manners the antenna module, and the present invention is not limited thereto.

Figure 5:
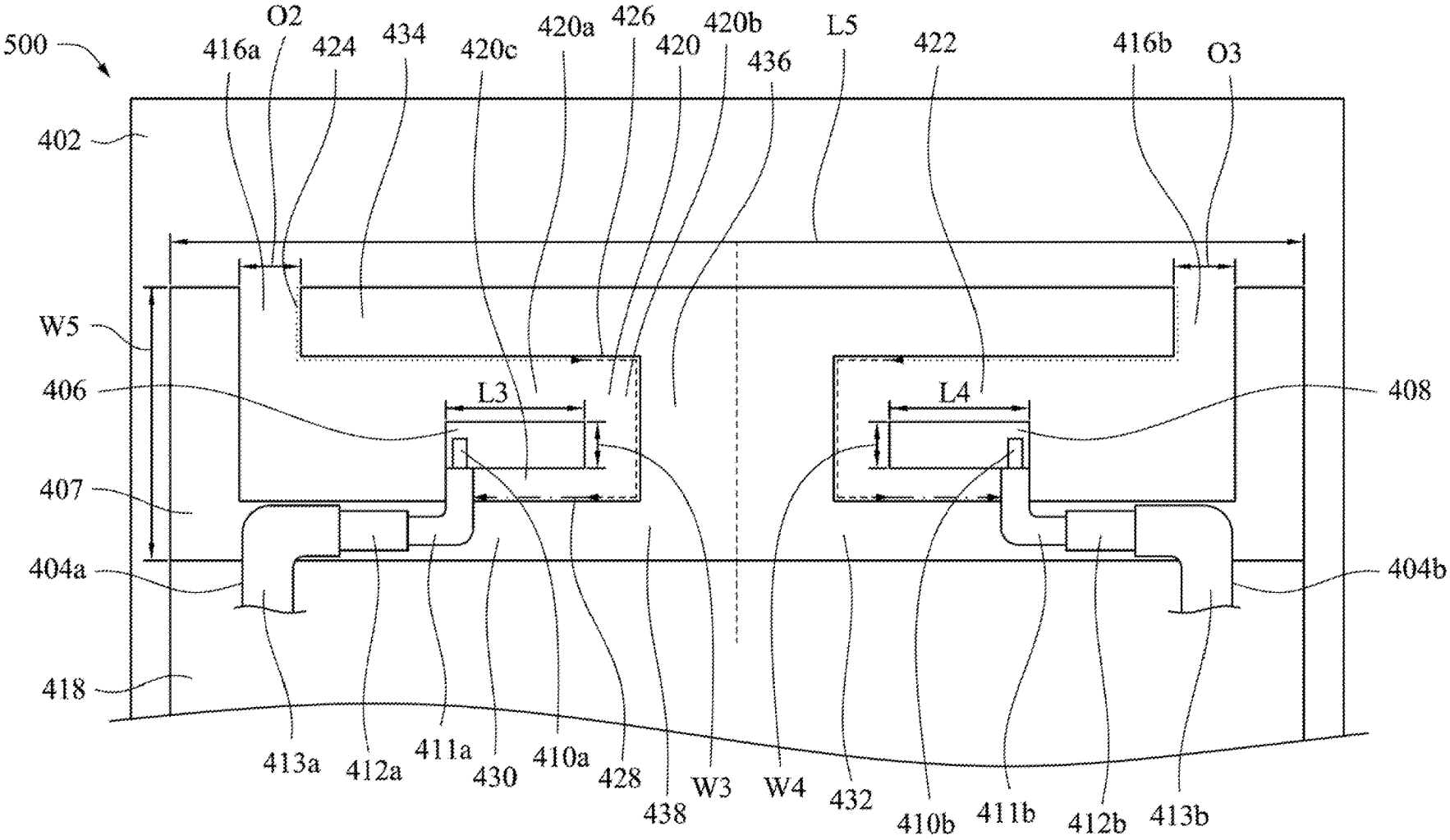
FIG. 5 is a schematic diagram of an antenna module according to embodiments of the present disclosure.

FIG. 5 is a schematic diagram of an antenna module according to embodiments of the present disclosure. As shown in FIG. 5, an antenna module 500 includes a substrate 402, a first coaxial-transmission line 404*a*, a second coaxial-transmission line 404*b*, a first radiator 406, a second radiator 408 and a third radiator 407. The first coaxial-transmission line 404*a* includes a first power feed-in terminal 410*a* and a first ground terminal 412*a*. The second coaxial-transmission line 404*b* includes a second power feed-in terminal 410*b* and a second ground terminal 412*b*. The first radiator 406 is electrically connected to the first power feed-in terminal 410*a*, the second radiator 408 is electrically connected to the second power feed-in terminal 410*b*, and the third radiator 407 is electrically connected to the first ground terminal 412*a* and the second ground terminal 412*b*. For example, the first radiator 406, the second radiator 408 and the third radiator 407 are made of metal or any material which can be used to be conductive.

For example, the first coaxial-transmission line 404*a* includes a first power feed-in terminal 410*a*, a first non-conductive section 411*a*, a first ground terminal 412*a* and a second non-conductive section 413*a*. Firstly, the first power feed-in terminal 410*a* is disposed as a center, and then the first power feed-in terminal 410*a*, the first non-conductive section 411*a*, the first ground terminal 412*a* and the second non-conductive section 413*a* are sequentially encased to form the first coaxial-transmission line 404*a*. The second coaxial-transmission line 404*b* includes the second power feed-in terminal 410*b*, a first non-conductive section 411*b*, the second ground terminal 412*b* and a second non-conductive section 413*b*. Since formation of the second coaxial-transmission line 404*b* is the same as that of the first coaxial-transmission line 404*a*, so this will not be repeated.

In this embodiment, the third radiator 407 is partially surrounding to the first radiator 406 and the second radiator 408, and the first radiator 406, the second radiator 408 and the third radiator 407 are coplanarly disposed on the substrate 402. In one embodiment, the first radiator 406, the second radiator 408 and the third radiator 407 are directly disposed on the substrate 402. For example, there is no element disposed between the first radiator 406 and the substrate 402; there is no element disposed between the second radiator 408 and the substrate 402; there is no element disposed between the third radiator 407 and the substrate 402.

One side of the third radiator 407 is connected to the system ground 418, and the system ground 418 is configured to connect the antenna module 400 with other element. For example, the system ground 418 can be made of cooper foil or any material which can be used to stably connect the antenna module 400 with other function elements. The function elements connected to the antenna module 400 via the system ground 418 can be a charging element, a photographic element, a touch element or a displaying element, etc. The third radiator 407 includes a first terminal, a second terminal, a third terminal and a fourth terminal. A first opening 416*a* is formed between the first terminal and the second terminal of the third radiator 407, and a second opening 416*b* is formed between the third terminal and the fourth terminal of the third radiator 407, so that the third radiator 407 is partially surrounding to the first radiator 406 and the second radiator 408. It should be noted that, the embodiments mentioned above are merely used for illustrating some manners of implementing the first opening 416*a* and the second opening 416*b*, and the present invention is not limited thereto.

Several slots which are in connection with the first opening 416*a* are formed between the first radiator 406 and the third radiator 407 (such as, the first slot 420 as shown in FIG. 4). Several slots which are in connection with the second opening 416*b* are formed between the second radiator 408 and the third radiator 407 (such as, the second slot 422 as shown in FIG. 4). For example, since the first radiator 406 and the second radiator 408 are disposed on the substrate 402 and indirectly connected to the third radiator 407, a distance is located between the first radiator 406 and the third radiator 407, and a distance is located between the second radiator 408 and the third radiator 407. In this embodiment, the distance between the first radiator 406 and the third radiator 407 and the distance between the second radiator 408 and the third radiator 407 are used to form several slots, and these slots are respectively in connection with the first opening 416*a* and the second opening 416*b*.

In one embodiment, a slot is formed by a first slit (such as, a first slit 420*a* as shown in FIG. 5), a connection slit (such as, a connection slit 420*b* as shown in FIG. 5) and a second slit (such as, a second slit 420*c* as shown in FIG. 5). Since formation of the first slit, the connection slit and the second slit are illustrated by the embodiments mentioned above, so these will not be repeated.

According to the embodiments mentioned above, an operational band of the antenna module 500 relates to an extending distance of the first slit, an extending distance of the connection slit and an extending distance of the second slit. Specifically, the extending distance are respectively measured are from one terminal of the first slit, the connection slit and the second slit to the other terminal of the first slit, the connection slit and the second slit along an internal side of the third radiator 407. Manners of measuring the extending distance of the first slit, the connection slit and the second slit are illustrated by the embodiments mentioned above, so these will not be repeated. Additionally, with respect to the extending distance of the first slit and the second slit which merely relate to length implementation of the first slit and the second slit, the extending distance of the connection slit relates to length implementation and width implementation of the connection slit. For example, the first slit and the second slit can be straight slits (such as, the first slit 420*a* and the second slit 420*c* as shown in FIG. 5), and the connection slit can be a zigzag slit (such as, the connection slit 420*b* as shown in FIG. 5). The specific extending distance of the connection slit can be further extended by the width implementation.

In one embodiment, the third radiator 407 includes a first radiating section 430 and a second radiating section 432 (such as, a dash line divides the third radiator 407 into the first radiating section 430 and the second radiating section 432 as shown in FIG. 5). The first radiating section 430 is partially surrounding to the first radiator 406, and the second radiating section 432 is partially surrounding to the second radiator 408. For example, the first radiating section 430 includes a first terminal and a second terminal of the third radiator 407, and the second radiating section 432 includes a third terminal and a fourth terminal of the third radiator 407.

Additionally, the first slot 420 is formed between the first radiator 406 and the first radiating section 430, and the second slot 422 is formed between the second radiator 408 and the second radiating section 432. The first slot 420 and the second slot 422 are respectively in connection with the first opening 416*a* and the second opening 416*b*, and the first slot 420 non-overlaps the second slot 422. Additionally, a size of the first radiating section 430 and a size of the second radiating section 432 are symmetric, so that the extending distance corresponding to the first slot 420, the extending distance corresponding to the second slot 422 and operational bands generated from the antenna module 400 are directly affected. Specifically, in the embodiment as shown in FIG. 5, the extending distance of the first slot 420 is the same as that of the second slot 422, thus the operational bands generated from the antenna module 400 via the first slot 420 and the second slot 422 are same.

In further embodiment, the first radiating section 430 includes a first radiating sub-section 434, a second radiating sub-section 436 and a third radiating sub-section 438. The first slit 420*a* is formed between the first radiator 406 and the first radiating sub-section 434; the connection slit 420*b* is formed between the first radiator 406 and the second radiating sub-section 436; the second slit 420*c* is formed between the first radiator 406 and the third radiating sub-section 438. An operational band of the antenna module 400 relates to the extending distance 424 of the first slit 420*a*, the extending distance 426 of the connection slit 420*b* and the extending distance 428 of the second slit 420*c*. Manners of measuring the extending distance 424 of the first slit 420*a*, the extending distance 426 of the connection slit 420*b* and the extending distance 428 of the second slit 420*c* are illustrated by the previous embodiments, so these will not be repeated. Additionally, since formation of the second slot 422 is similar to that of the first slot 420, so this will not be repeated.

According to the embodiments mentioned above, energy is provided to the antenna module 500 respectively via the first source feed-in terminal 410*a* of the first coaxial-transmission line 404*a* and the second source feed-in terminal 410*b* of the second coaxial-transmission line 404*b*. Then, the first ground terminal 412*a* and the second ground terminal 412*b* are respectively connected to the third radiator 407 to conduct electricity to the system ground 418, so that the antenna module 500 respectively generates a first operational band and a second operational band via the first slot 420 and the second slot 422. In other words, when the antenna module 500 is designed, resonant frequencies and impedance bandwidths of the first operational band and the second operational band generated from the antenna module 500 can be adjusted by adjusting the extending distance corresponding to the first slot and the second slot. For example, the first operational band can represent wireless bands 3.3~3.8 GHz supported by the $5^{th}$ generation mobile communication (5G), and the second operational band can represent wireless bands 3.3~3.8 GHz supported by the $5^{th}$ generation mobile communication (5G).

In one embodiment, when the first operational band and the second operational band represent the wireless bands 3.3~3.8 GHz supported by the $5^{th}$ generation mobile communication (5G), a length L3 of the first radiator 406 and a length L4 of the second radiator 408 are in the range of 2 millimeters to 5 millimeters, and a width W3 of the first radiator 406 and a width W4 of the second radiator 408 are in the range of 0.5 millimeter to 1.5 millimeters; a length L5 of the third radiator 407 is 36 millimeters, and a width W5 of the third radiator 407 is 6 millimeters; an opening width O2 of the first opening 416*a* and an opening width O3 of the second opening 416*b* are 0.5 millimeter to 1.5 millimeters. It should be noted that, the specific implantation of the first radiator 406, the second radiator 408, the third radiator 407, the first opening 416*a* and the second opening 416*b* in this embodiment are merely used for illustration, and the present invention is not limited thereto.

In the embodiment as shown in FIG. 5, the antenna module 500 which applies the first coaxial-transmission line 404*a* and the second coaxial-transmission line 404*b* is a double feed-in and single-band antenna module. Since the antenna module 500 simultaneously applies the first coaxial-transmission line 404*a* and the second coaxial-transmission line 404*b*, the antenna module 500 can not only operate at the first operational band simultaneously or non-simultaneously via the first slot 420 and the second slot 422, but also support multi-input and multi-output (MIMO) technology. It should be noted that, the double feed-in and single-band antenna module which applies the double coaxial-transmission lines in the embodiments mentioned above is used for illustrating some possible manners of implementing the antenna module 500, and the present invention is not limited thereto. For example, the antenna module can be designed as a double feed-in antenna module or a multi-feed-in antenna module or be designed as a single-band antenna module or a multi-band antenna module by adjusting the number of the coaxial-transmission lines or an extending distance of a slot while designing the antenna module.

In one embodiment, possible configuration manners and application manners of the antenna module 500 are illustrated by the embodiments as shown in FIG. 2, FIG. 3A and FIG. 3B, so these will not be repeated. It should be noted that, the embodiments mentioned above are merely used for illustrating the specific configuration manners and application manners of the antenna module, and the present invention is not limited thereto.

In the embodiments mentioned above, the present invention integrates several radiators and coplanarly discloses the radiators on the substrate, so as to trigger an antenna module to operate at different operational bands via extending distances corresponding to different slots. Volume of the antenna module in a communication electronic device can be dramatically decreased by the present invention technology of coplanarly disposing the radiators and disposing several openings which are in connection with the slots on the same side of the radiator, so that design of a circuit in the communication electronic device becomes more flexible. Additionally, manpower consumption of adjusting the antenna module and operational frequencies of the antenna module can be further decreased by a technical feature of coplanarly disposing the radiators.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present invention cover modifications and variations of this present disclosure provided they fall within the scope of the following claims.

What is claimed is:

1. An antenna module, connected to a system ground of an electronic device, wherein the antenna module comprises:

a substrate;

a coaxial-transmission line, comprising a power feed-in terminal and a ground terminal;

a first radiator, electrically connected to the power feed-in terminal; and a second radiator, electrically connected to the ground terminal, wherein one side of the second radiator is connected to the system ground, and the second radiator comprises a first terminal and a second terminal, wherein an opening is formed between the first terminal and the second terminal, so that the second radiator is partially surrounding to the first radiator, and the first radiator and the second radiator are coplanarly disposed on the substrate, wherein the first radiator is arranged within an enclosed area formed with the second radiator and the opening, the first radiator has two opposing ends, the first power feed-in terminal is connected to one of the two opposing ends and does not pass through the opening, and the first radiator extends between the two opposing ends in a length direction of the first radiator, wherein, when viewed with respect to the length direction, the first opening is arranged between the two opposing ends.

2. The antenna module of claim 1, wherein the second radiator further comprises a first radiating section and a second radiating section, a first slot is formed between the first radiator and the first radiating section, a second slot is formed between the first radiator and the second radiating section, wherein the first slot and the second slot are in connection with the opening, and the first slot non-overlaps the second slot.

3. The antenna module of claim 2, wherein the first radiating section comprises a first radiating sub-section, a second radiating sub-section and a third radiating sub-section, a first slit is formed between the first radiator and the first radiating sub-section, a first connection slit is formed between the first radiator and the second radiating sub-section, and a second slit is formed between the first radiator and the third radiating sub-section, wherein the first slit, the first connection slit and the second slit are in connection to form the first slot.

4. The antenna module of claim 3, wherein the second radiating section comprises a fourth radiating sub-section, a fifth radiating sub-section and a sixth radiating sub-section, a third slit is formed between the first radiator and the fourth radiating sub-section, a second connection slit is formed between the first radiator and the fifth radiating sub-section, and a fourth slit is formed between the first radiator and the sixth radiating sub-section, wherein the third slit, the second connection slit and the fourth slit are in connection to form the second slot.

5. The antenna module of claim 4, wherein a length of the first radiator is in the range of 10 millimeters to 15 millimeters, and a width of the first radiator is in the range of 0.5 millimeter to 1.5 millimeters; a length of the second radiator is in the range of 20 millimeters to 40 millimeters, and a width of the second radiator is in the range of 3 millimeters to 7 millimeters.

6. The antenna module of claim 5, wherein a width of the opening is in the range of 1 millimeter to 2 millimeters.

7. An antenna module, connected to a system ground of an electronic device, wherein the antenna module comprises:

a substrate;

a first coaxial-transmission line, comprising a first power feed-in terminal and a first ground terminal;

a second coaxial-transmission line, comprising a second power feed-in terminal and a second ground terminal;

a first radiator, electrically connected to the first power feed-in terminal;

a second radiator, electrically connected to the second power feed-in terminal; and a third radiator, electrically connected to the first ground terminal and the second ground terminal, wherein one side of the third radiator is connected to the system ground, and the third radiator comprises a first terminal, a second terminal, a third terminal and a fourth terminal, so that the third radiator is partially surrounding to the first radiator and the second radiator, wherein a first opening is formed between the first terminal and the second terminal, a second opening is formed between the third terminal and the fourth terminal, and the first radiator, the second radiator and the third radiator are coplanarly disposed on the substrate, wherein the first opening is disconnected from the second opening.

8. The antenna module of claim 7, wherein the third radiator further comprises a first radiating section and a second radiating section, the first radiating section is partially surrounding to the first radiator, and the second radiating section is partially surrounding to the second radiator, wherein first radiating section comprises the first terminal and the second terminal of the third radiator, and the second radiating section comprises the third terminal and the fourth terminal of the third radiator.

9. The antenna module of claim 8, wherein a firs slot is formed between the first radiator and the first radiating section, and a second slot is formed between the second radiator and the second radiating section, wherein the first slot are in connection with the first opening, the second slot are in connection with the second opening, and the first slot non-overlaps the second slot.

10. The antenna module of claim 9, wherein the first radiating section further comprises a first radiating sub-section, a second radiating sub-section and a third radiating sub-section, a first slit is formed between the first radiator and the first radiating sub-section, a first connection slot is formed between the first radiator and the second radiating sub-section, a second slit is formed between the first radiator and the third radiating sub-section, wherein the first slit, the first connection slit and the second slit are in connection to form the first slot.

11. The antenna module of claim 10, wherein the third radiating section further comprises a fourth radiating sub-section, a fifth radiating sub-section and a sixth radiating sub-section, a third slit is formed between the second radiator and the fourth radiating sub-section, a second connection slit is formed between the second radiator and the fifth radiating sub-section, and a fourth slit is formed between the second radiator and the sixth radiating sub-section, wherein the third slit, the second connection slit and the fourth slit are in connection to form the second slot.

12. The antenna module of claim 9, wherein a length of the first radiator and a length of the second radiator are in the range of 2 millimeters to 5 millimeters, and a width of the first radiator and a width of the second radiator are in the range of 0.5 millimeter to 1.5 millimeters; a length of the third radiator is in the range of 20 millimeters to 40 millimeters, and a width of the third radiator is in the range of 3 millimeters to 8 millimeters.

13. The antenna module of claim 12, wherein a width of the first opening is in the range of 1 millimeter to 2 millimeters, and a width of the second opening is in the range of 0.75 millimeter to 1.5 millimeters.

14. The antenna module of claim 12, wherein a width of the first opening and a width of the second opening are in the range of 0.75 millimeter to 2 millimeters.

* * * * *